US008113505B2

(12) United States Patent
Lee

(10) Patent No.: US 8,113,505 B2
(45) Date of Patent: Feb. 14, 2012

(54) IMAGE FORMING APPARATUS AND PAPER FEEDING DEVICE THEREOF

(75) Inventor: Jin Soo Lee, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 12/621,994

(22) Filed: Nov. 19, 2009

(65) Prior Publication Data

US 2010/0156033 A1 Jun. 24, 2010

(30) Foreign Application Priority Data

Dec. 19, 2008 (KR) ..... 10-2008-0130234

(51) Int. Cl.
*B65H 3/34* (2006.01)
*B65H 3/52* (2006.01)

(52) U.S. Cl. ..... 271/167; 271/121; 271/124

(58) Field of Classification Search ..... 271/121, 271/122, 124, 167
See application file for complete search history.

(56) References Cited

U.S. PATENT DOCUMENTS 4,526,358 A * 7/1985 Ura et al. ..... 271/34
4,572,498 A * 2/1986 Shiozawa ..... 271/34
5,451,043 A * 9/1995 Arai ..... 271/122
5,996,989 A * 12/1999 Cahill et al. ..... 271/121
6,331,001 B1 * 12/2001 Sekiguchi ..... 271/9.01
7,543,814 B2 * 6/2009 Qi et al. ..... 271/167
7,648,134 B2 * 1/2010 Lim ..... 271/118
2004/0065992 A1 * 4/2004 Youn ..... 271/121
2005/0067758 A1 * 3/2005 Seki et al. ..... 271/121
2007/0001376 A1 * 1/2007 Lim et al. ..... 271/121

FOREIGN PATENT DOCUMENTS

JP 09-221247 8/1997

OTHER PUBLICATIONS

English language abstract of JP 09-221247, published Aug. 26, 1997.
Machine English language translation of JP 09-221247, published Aug. 26, 1997.

* cited by examiner

*Primary Examiner* — Kaitlin Joerger
*Assistant Examiner* — Patrick Cicchino
(74) *Attorney, Agent, or Firm* — Stanzione & Kim, LLP

(57) ABSTRACT

Disclosed herein are a paper feeding device and an image forming apparatus capable a convenient removal a paper jammed between a pickup unit and a multi-sheet feeding prevention unit. The multi-sheet feeding prevention unit may be moveable in cooperation with a detachable paper cassette such that the multi-sheet feeding prevention member supported on the moveable multi-sheet feeding prevention unit moves toward and away from the pickup unit so that the pressing force between the pickup unit and the multi-sheet feeding prevention unit may be released to allow the jammed paper to be removed.

19 Claims, 5 Drawing Sheets

IMAGE FORMING APPARATUS AND PAPER FEEDING DEVICE THEREOF

CROSS-REFERENCE TO RELATED APPLICATION

This application claims the benefit of Korean Patent Application No. 2008-0130234, filed on Dec. 19, 2008 in the Korean Intellectual Property Office, the disclosure of which is incorporated herein by reference in its entirety.

TECHNICAL FIELD

The present disclosure relate generally to an image forming apparatus having an improved paper feeding performance.

BACKGROUND OF RELATED ART

Generally speaking, image forming apparatuses refer to apparatuses forming images on printing media, and may include, e.g., a printer, a copier, a facsimile and a multifunction apparatus that combines some functions of the aforementioned. Hereinafter, for the sake of convenience and readability, the printing medium may be referred to as 'paper' in the descriptions below, which should not, however, be construed as limiting the printing medium to paper.

The image forming apparatus is equipped with a paper feeding device that supplies paper to a printing device also included in the apparatus. The paper received in the paper feeding device is picked up by a pickup unit, and is fed to the printing device along a predetermined path.

The paper feeding device may include a multi-sheet feeding prevention unit to prevent simultaneous feeding of multiple sheets of paper. The multi-sheet feeding prevention unit is typically disposed to face the pickup unit and to bias the paper toward the pickup unit.

While the image forming apparatus is performing a printing operation, the paper may be caught between the pickup unit and the multi-sheet feeding prevention unit, resulting in a paper because of the pressure exerted between the pickup unit and the multi-sheet feeding prevention unit. If the user forcibly pulls on the paper, the paper, the pickup unit, and/or the multi-sheet feeding prevention unit may become damaged. A paper feeding device capable of convenient removal of jammed paper is thus desirable.

SUMMARY OF DISCLOSURE

In accordance with one aspect of the present invention, an image forming apparatus may be provided to comprise a main body, a printing media feeding cassette, a pickup roller and a multi-sheet feeding prevention unit. The main body may be configured to support a printing device received therein. The printing media feeding cassette may be detachably mounted to the main body, and may be configured to support one or more printing media receive therein. The pickup roller may be configured to pick up a printing medium from the printing media feeding cassette. The multi-sheet feeding prevention unit may be configured to impart a pressing force on the pickup roller when the multi-sheet feeding prevention unit is in a contact position and to release the pressing force to the pickup roller when the multi-sheet feeding prevention unit is in a releasing position. The multi-sheet feeding prevention unit may be in the contact position when the printing media feeding caste is mounted to the main body, and may be in the releasing position when the printing media feeding cassette is at least partially detached from the main body.

The multi-sheet feeding prevention unit may comprise a multi-sheet feeding prevention member facing the pickup roller and a holder supporting the multi-sheet feeding prevention member.

The printing media feeding cassette, when it is mounted in the main body, may press against the holder so that the multi-sheet feeding prevention member is in a pressing contact with the pickup roller.

The multi-sheet feeding prevention unit may further comprise an elastic member to elastically bias the holder in such a manner elastically biasing the multi-sheet feeding prevention member toward the pickup roller.

One end of the elastic member may be supported by the holder while the other end of the elastic member may be supported by the printing media feeding cassette.

The holder may comprise a rotating shaft, a supporting arm and an operating arm. The supporting arm may extend from the rotating shaft, and may be configured to support the multi-sheet feeding prevention member. The operating arm may extend from the rotating shaft, and may be configured to face the printing media feeding cassette.

The image forming apparatus may further comprise an elastic member disposed between the operating arm and the printing media feeding cassette.

The multi-sheet feeding prevention unit may further comprise a cap coupled to the operating arm and configured to receive the elastic member.

The image forming apparatus may further comprise a guide frame having a guide surface by which the printing medium picked up by the pickup roller is guided along a paper feed path. The holder may be rotatably mounted to the guide frame.

According to another aspect of the present disclosure, an image forming apparatus may be provided to comprise a printing media feeding cassette, a pickup roller and a multi-sheet feeding prevention unit. The printing media feeding cassette may have a paper receiving surface on which one or more sheets of paper are to be stacked. The pickup roller may be configured to pick up a paper from the printing media feeding cassette. The multi-sheet feeding prevention unit may be moveable between a contact position and a releasing position, and may have a multi-sheet feeding prevention member supported on an end thereof. The multi-sheet feeding prevention unit may be configured to be in the contact position when the multi-sheet feeding prevention unit is in an interfering contact with the printing media feeding cassette. The multi-sheet feeding prevention member may impart a first pressing force on the pickup roller when the multi-sheet feeding prevention unit is in the contact position. The multi-sheet feeding prevention unit may be configured to be in the releasing position when the multi-sheet feeding prevention unit is not in contact with the printing media feeding cassette. The multi-sheet feeding prevention member may impart a second pressing force less than the first pressing force on the pickup roller when the multi-sheet feeding prevention unit is in the releasing position.

When the multi-sheet feeding prevention unit is in the releasing position, the multi-sheet feeding prevention member may not contact the pickup roller so that the second pressing force imparted on the pickup roller is zero.

The multi-sheet feeding prevention unit may further comprise a holder and an elastic member. The holder may be rotatably disposed in the image forming apparatus, and may be configured to support the multi-sheet feeding prevention member. One end of the elastic member may be supported by the holder while the other end may be supported by the printing media feeding cassette.

The holder may comprise a rotating shaft, a supporting arm and an operating arm. The supporting arm may extend from the rotating shaft in a first direction toward the pickup roller, and may support the multi-sheet feeding prevention member at one end thereof away from the rotating shaft. The operating arm may extend from the rotating shaft in a second direction away from the pickup roller, and may have a surface opposingly facing the printing media feeding cassette.

The printing media feeding cassette may be configured to press against the operating arm of the holder so as to bias the multi-sheet feeding prevention member toward the pickup roller.

The image forming apparatus may further comprise a guide frame having a guide surface by which the printing medium picked up by the pickup roller is guided along a paper feed path defined within the image forming apparatus. The holder may be rotatably supported on the guide frame.

According to yet another aspect of the present disclosure, a printing media feeding device may be useable in an image forming apparatus that includes a printing media feeding cassette in which to receive one or more printing media, and may comprise a pickup roller and a multi-sheet feeding prevention unit. The pickup roller may be configured to pickup up a printing medium from the printing media feeding cassette. The multi-sheet feeding prevention unit may have a multi-sheet feeding prevention member opposingly facing the pickup roller. The multi-sheet feeding prevention unit may be configured to rotate about a rotational shaft in cooperation with the printing media feeding cassette of the image forming apparatus.

The multi-sheet feeding prevention unit may be rotatable about the rotational shaft between a pressing position and a releasing position. The multi-sheet feeding prevention unit may be in the pressing position when the multi-sheet feeding prevention unit is in an interfering contact with the printing media cassette installed in the image forming apparatus. The multi-sheet feeding prevention unit may be in the releasing position when the multi-sheet feeding prevention unit is not in contact with the printing media cassette. The multi-sheet feeding prevention member may impart a first pressing force on the pickup roller when the multi-sheet feeding prevention unit is in the pressing position. The multi-sheet feeding prevention member may impart a second pressing force less than the first pressing force on the pickup roller when the multi-sheet feeding prevention unit is in the releasing position.

The multi-sheet feeding prevention unit may further comprise a supporting arm and an operating arm. The supporting arm may extend from the rotational shaft in a first direction toward the pickup roller, and may support the multi-sheet feeding prevention member at one end thereof away from the rotational shaft. The operating arm may extend from the rotational shaft in a second direction away from the pickup roller, and may have a surface opposingly facing the printing media feeding cassette.

The multi-sheet feeding prevention unit may further comprise an elastic member disposed between the printing media feeding cassette and the operating arm. The elastic member may elastically bias the multi-sheet feeding prevention member toward the pickup roller when the multi-sheet feeding prevention unit is in a pressing contact with the printing media feeding cassette.

When the printing media feeding cassette is in pressing contact with the operating arm of the multi-sheet feeding prevention unit, the multi-sheet feeding prevention member may impart a first pressing force on the pickup roller. When the operating arm of the multi-sheet feeding prevention unit is not in contact with the printing media cassette, the multi-sheet feeding prevention member may impart a second pressing force less than the first pressing force on the pickup roller.

BRIEF DESCRIPTION OF THE DRAWINGS

Various features and advantages of the disclosure will become more apparent by the following detailed description of several embodiments thereof with reference to the attached drawings, of which.

DETAILED DESCRIPTION OF SEVERAL EMBODIMENTS

Figure 1:
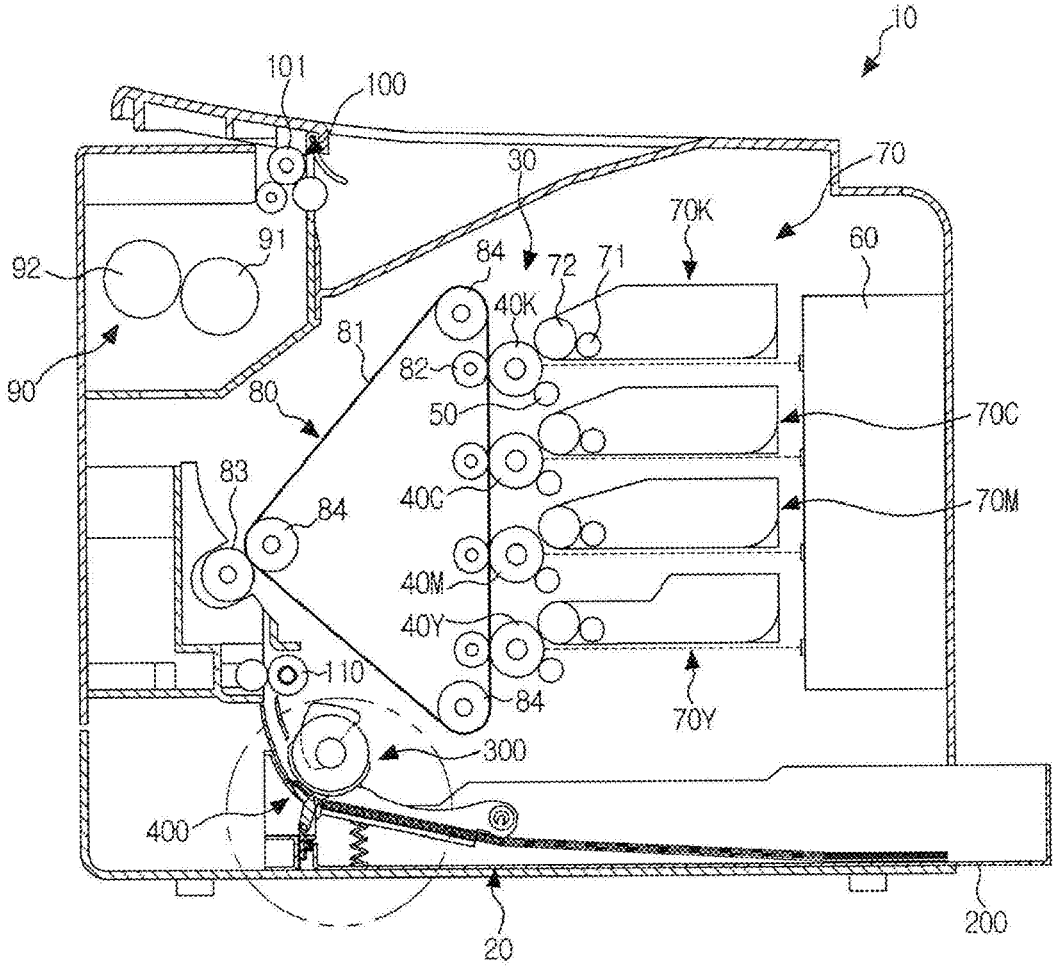
FIG. 1 is a view showing the structure of an image forming apparatus according to an embodiment of the present disclosure.

Reference will now be made in detail to the embodiment, examples of which are illustrated in the accompanying drawings, wherein like reference numerals refer to like elements throughout. While the embodiments are described with detailed construction and elements to assist in a comprehensive understanding of the various applications and advantages of the embodiments, it should be apparent however that the embodiments can be carried out without those specifically detailed particulars. Also, well-known functions or constructions will not be described in detail so as to avoid obscuring the description with unnecessary detail. It should be also noted that in the drawings, the dimensions of the features are not intended to be to true scale and may be exaggerated for the sake of allowing greater understanding.

FIG. 1 is a view showing the structure of an image forming apparatus according to an embodiment of the present disclosure.

As shown in FIG. 1, an image forming apparatus 1 according to an embodiment may comprise a main body 10, a paper feeding device 20, a printing device 30 and a paper discharging device 100.

The main body 10 may define the overall external appearance of the image forming apparatus, and may support various components therein. The paper feeding device 20 supplies paper to the printing device 30. The paper feeding device 20 will be described in greater detail later.

The printing device 30 prints images on the paper fed from the paper feeding device 20. By way of a non-limiting example, an electrophotographic type image forming apparatus is described below. However, it should be readily apparent to those skilled in the art that various aspects and embodiments herein described are applicable to other types of image forming apparatus, including, for example, an inkjet type image forming apparatus. According to an embodiment, the printing device 30 of an electrophotographic type image forming apparatus may comprise photosensitive mediums 40K, 40C 40M and 40Y, charging devices 50, a laser scanning unit 60, a developing unit 70, a transfer unit 80 and a fixing unit 90.

The charging devices 50 may uniformly electrify the surface of the respective corresponding one of the photosensitive mediums 40K, 40C 40M and 40Y. The laser scanning unit 60 may scan the electrified surfaces of the photosensitive mediums 40K, 40C 40M and 40Y with laser beams corresponding to the image data, thereby forming electrostatic latent images on the surfaces of the photosensitive mediums 40K, 40C 40M and 40Y.

The developing unit 70 may supply toner to the electrostatic latent images formed on the photosensitive mediums 40K, 40C 40M and 40Y, thereby developing the electrostatic latent images into visible toner images. For example, the developing unit 70 may be constituted by four developing devices 70K, 70C 70M and 70Y, storing black, cyan, magenta and yellow toners, respectively.

Each of the developing devices 70K, 70C 70M and 70Y may include a supplying roller 71 and a developing roller 72. The supplying rollers 71 supply the toner to the corresponding developing roller 72. The developing rollers 72 in turn supply the toner respectively to the photosensitive mediums 40K, 40C, 40M and 40Y to develop the electrostatic latent images into the visible toner images.

The transfer unit 80 may comprise a transfer belt 81, first transfer rollers 82, a second transfer roller 83 and supporting rollers 84. The transfer rollers 81 may rotates while pressing against the corresponding one of the photosensitive mediums 40K, 40C 40M and 40Y. The transfer belt 81 may rotate while being supported by the supporting rollers 84 around a loop path that includes a portion in which the transfer belt 81 is interposed between the transfer rollers 81 and the photosensitive mediums 40K, 40C 40M and 40Y.

The visible images formed on the photosensitive mediums 40K, 40C 40M and 40Y may be transferred to the transfer belt 81 by the first transfer rollers 82 in an overlapping manner. The overlapped images on the transfer belt 81 may be transferred onto a paper fed from the paper feeding device 20 that pass between the second transfer roller 83 and the transfer belt 81.

The paper that has passed through the transfer unit 80 may subsequently be introduced into the fixing device 90, which may comprise a heating roller 91 and a pressing roller 92. The paper bearing thereon the transferred toner images may be made to pass between the heating roller 91 and the pressing roller 92, during which the toner images are fixed to the paper by heat and pressure.

Having passed through the fixing device 90, the paper may be guided to the paper discharging unit 100, and may be discharged to the outside by a discharging roller 101.

Figure 2:
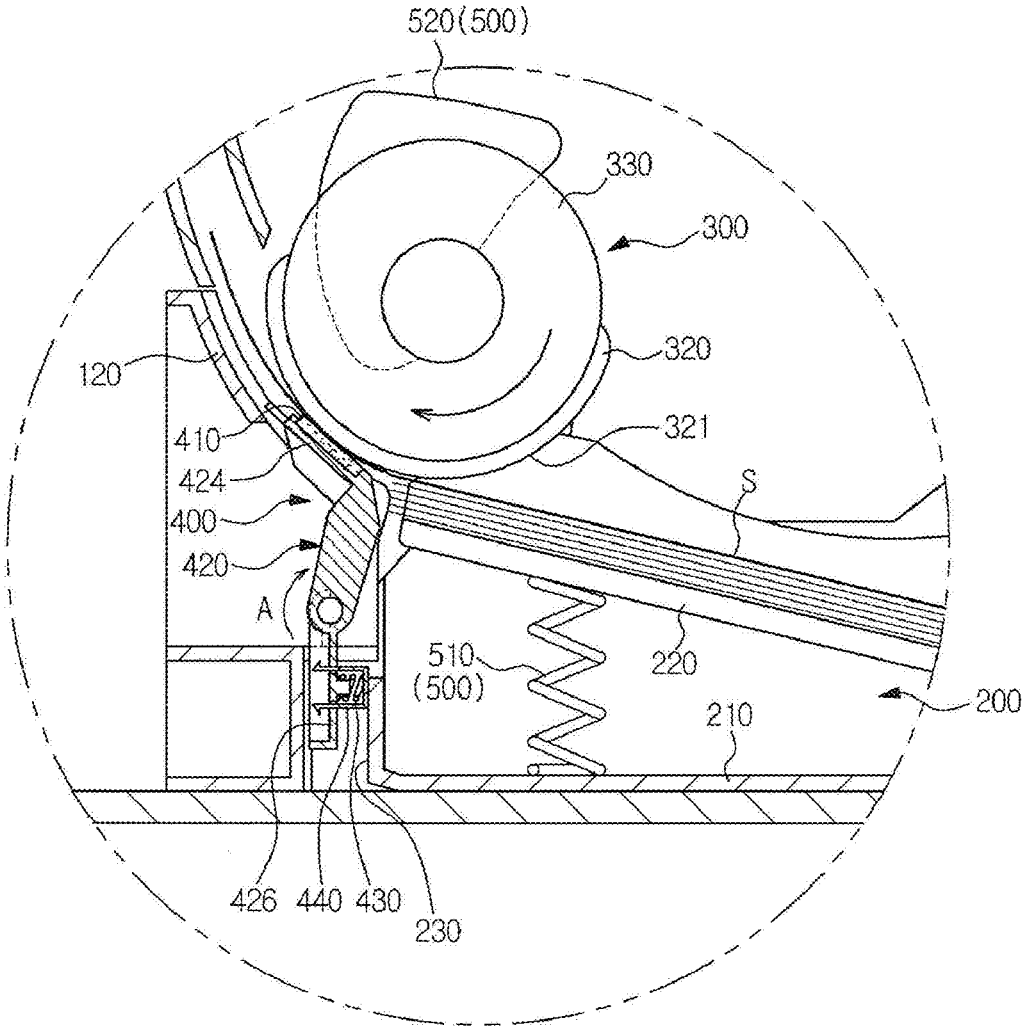
FIG. 2 is a partially enlarged view of the relevant portion of the image forming apparatus of FIG. 1.
Figure 3:
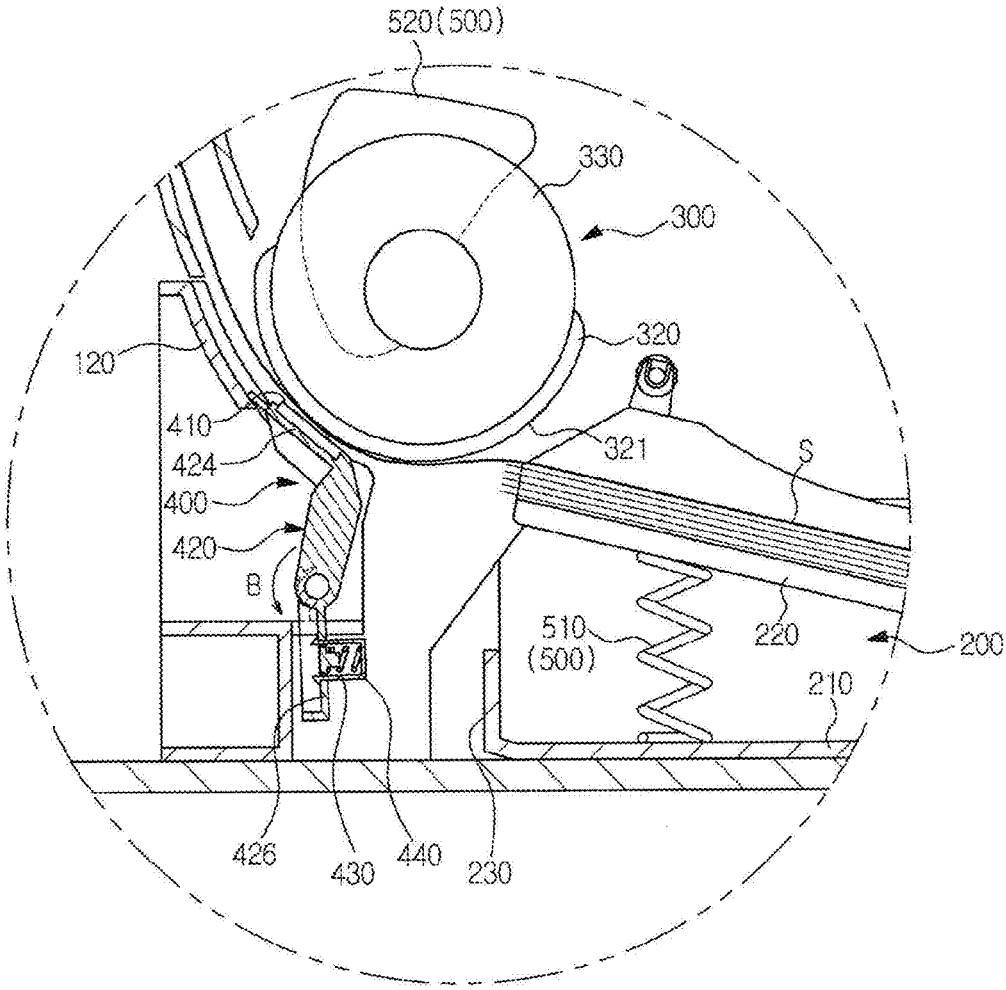
FIG. 3 shows the portion of an image forming apparatus shown in FIG. 2 with the paper feeding cassette separated.
Figure 4:
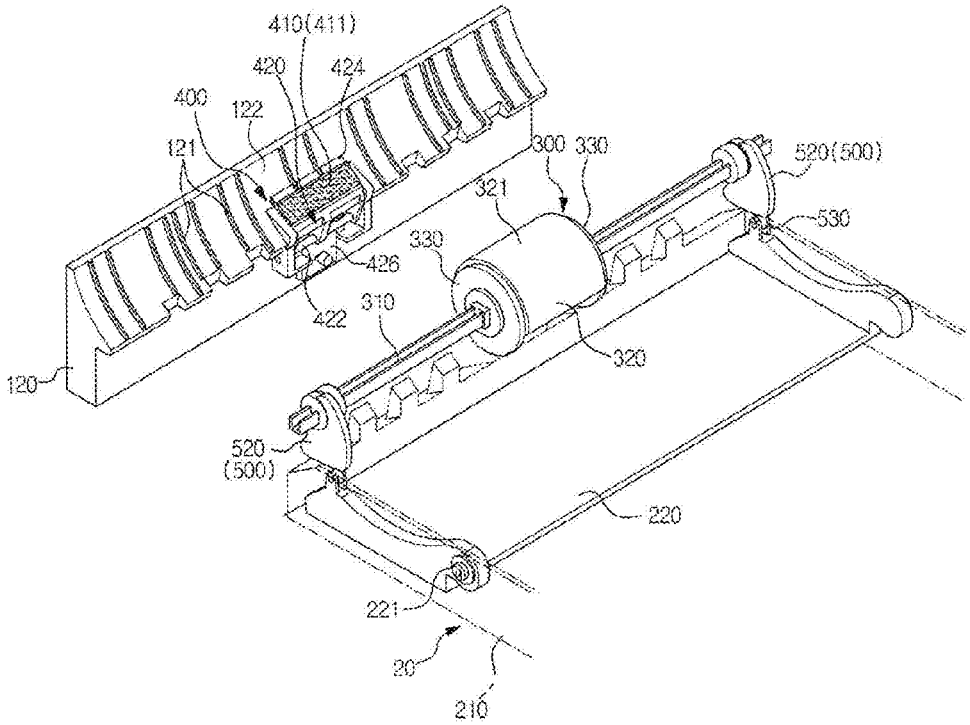
FIG. 4 is a perspective view showing the structure of a paper feeding device of an image forming apparatus according to an embodiment of the present disclosure.

FIG. 2 is a partially enlarged view of the circled portion of FIG. 1. FIG. 3 shows the portion shown in FIG. 2, but with the paper feeding cassette separated from the main body 10. FIG. 4 is a perspective view showing the structure of the paper feeding device according to an embodiment. In FIG. 4, a pickup guide and the paper feeding cassette are separately illustrated.

Referring to FIG. 1 to FIG. 4, the paper feeding device 20 according to an embodiment may comprise the paper feeding cassette 200, a pickup roller 300 and a multi-sheet feeding prevention unit 400.

The paper feeding cassette 200 is structured to receive papers S, and may be detachably mounted to the main body 10. The pickup roller 300 may pick up the paper S from the paper feeding cassette 200, and may feed the picked up paper S to a feeding roller 110 (shown in FIG. 1).

A guide frame 120 may further be provided in front of the paper feeding cassette 200. As shown in FIG. 4, the guide frame 120 may comprise a guide surface 122 having a plurality of ribs 121 extending along the paper feeding direction so as to guide the paper picked up by the pickup roller 300 to the feeding roller 110. The feeding roller 110 may align the leading end of the paper being fed from the pickup roller 300, and may feed the paper further along the paper path toward the second transfer roller 83.

The multi-sheet feeding prevention unit 400 may press against the pickup roller 300 so that the pickup roller 300 can pick up the paper one sheet at a time. To that end, the multi-sheet feeding prevention unit 400 may be disposed at a lower part of the pickup roller 300, and may press the rear side of the paper while the paper is being picked up, thereby reducing simultaneous pickup of multiple sheets, that is, a multi-sheet feeding.

The paper feeding cassette 200 may comprise a cassette body 210 and a knock-up plate 220 supporting the received paper S. The knock-up plate 220 may be pivotably mounted to the cassette body 210. More particularly, the knock-up plate 220 may be connected to the cassette body 210 through a hinge shaft 221 (see FIG. 4) formed at the rear end thereof, therefore allowing the leading end of the knock-up plate 220 to pivot up and down.

The pickup roller 300 may be disposed above the leading end of the knock-up plate 220. The pickup roller 300 may be connected to a pickup shaft 310 rotatably mounted to the main body 10. The pickup shaft 310 may be rotated by a rotational force received from a driving motor (not shown) mounted in the main body 10.

The pickup roller 300 may comprise a rotating pickup member 320 configured to contact the paper stacked on the knock-up plate 220 and a pair of idle rollers 330 mounted at the sides of the rotating pickup member 320 that may rotate idly.

The rotating pickup member 320 may include a contact part 321 contacting the paper only in a predetermined section during the rotation of the rotating pickup member 320. The contact part 321 may protrude in the radial direction of the idle roller 330. As shown in FIG. 2, when the contact part 321 of the rotating pickup member 320 is in contact with the paper, the idle roller 330 may be separated from the paper. On the other hand, when the contact part 321 is out of contact with the paper, the idle roller 330 may be in contact with the paper.

When the paper S passes by an upper part of the multi-sheet feeding prevention unit 400, the idle roller 330 presses the multi-sheet feeding prevention unit 400 with a predetermined pressure so that only the uppermost sheet of the paper may be picked up and fed from the knock-up plate 220.

The paper feeding device 20 may comprise an elevating unit 500 to move the knock-up plate 220 up and down. The elevating unit 500 may comprise a spring 510 elastically biasing the knock-up plate 220 upward and a pair of cams 520 that may be connected to both sides of the pickup shaft 310, and which may rotate along with the pickup roller 300.

While the pickup shaft 310 is rotating, the cams 520 press the sidewalls of the knock-up plate 220, thereby causing the knock-up plate 220 to pivot downward. Guide rollers 530 may be further formed at the sidewalls of the knock-up plate 220 at locations corresponding to the cams 520 so as to allow the cams 520 to press the knock-up plate 220 more efficiently.

When the cams 520 rotate to a position where they are separated from the knock-up plate 220, the knock-up plate 220 is pivoted upward by the spring 510.

Figure 5:
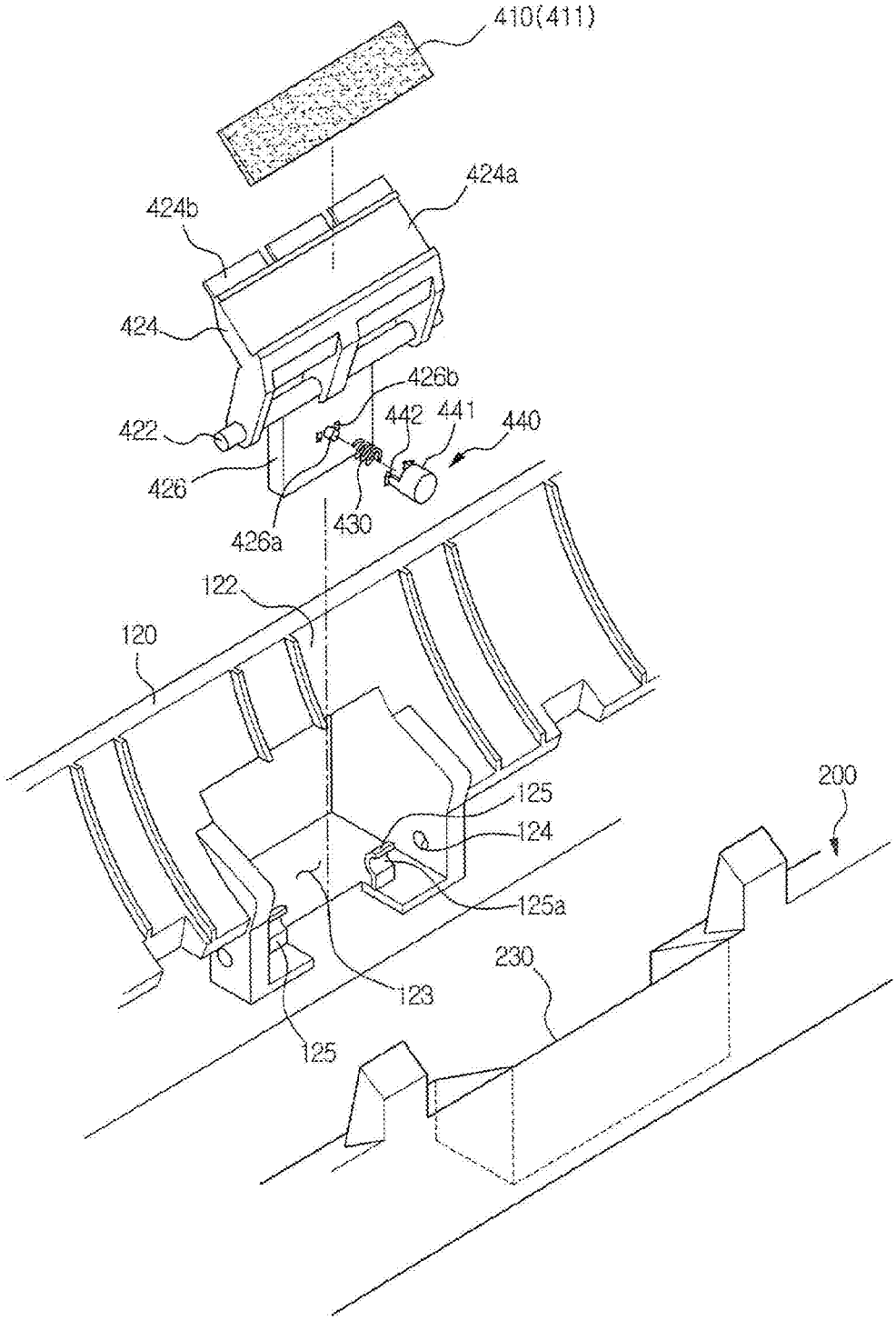
FIG. 5 is a perspective view showing portions of the paper feeding cassette, a pickup guide and a multi-sheet feeding prevention unit of the image forming apparatus according to an embodiment of the present disclosure.

FIG. 5 is a perspective view showing the pickup guide, a portion of the paper feeding cassette and the multi-sheet feeding prevention unit of an image forming apparatus according to an embodiment of the present disclosure.

As shown in FIGS. 2, 3 and 5, the multi-sheet feeding prevention unit 400 may comprise a multi-sheet feeding prevention member 410 facing the pickup roller 300, and a holder 420 supporting the multi-sheet feeding prevention member 410.

The multi-sheet feeding prevention member 410 may be configured to press against the pickup roller 300 when the pickup roller 300 picks up the paper. The multi-sheet feeding prevention unit 400 may further comprise a friction pad 411 imparting frictional force on the paper being passed through the pickup roller 300.

The holder 420 may be rotatably mounted to the guide frame 120 at a position corresponding to the pickup roller 300. The guide frame 120 may include a holder receiving part 123 that receives the holder 420. A shaft connection hole 124 may be formed on each side of the holder receiving part 123. In addition, a guide protrusion 125 including a shaft supporting recess 125*a* may be formed on the bottom surface of the holder receiving part 123.

The holder 420 may comprise a rotating shaft 422, a supporting arm 424 extending from the rotating shaft 422 in one direction and an operating arm 426 extending from the rotating shaft 422 in another substantially opposing direction. Both ends of the rotating shaft 422 may be received into the shaft connection holes 124 whereas the middle portion of the rotating shat 422 may be supported by the shaft supporting recess 125*a*.

An upper surface of the supporting arm 424 that faces the pickup roller 300 may have formed thereon a pad receiving recess 424*a* into which the friction pad 411 may be received. A locking protrusion 424*b* is protruded from an end of the supporting arm 424 such that the supporting arm 424 is supported by the guide surface 122 of the guide frame 120.

The operating arm 426 faces the paper feeding cassette 200 adjacent the front portion of the paper feeding cassette 200. A pressing part 230 may be formed on the front side of the paper feeding cassette 200 to press against the holder 420. When the paper feeding cassette 200 is mounted to the main body 10, the pressing part 230 may press the operating arm 426 of the holder 420, thereby bringing the multi-sheet feeding prevention member 410 into close contact with the pickup roller 300.

As shown in FIG. 3, when the paper feeding cassette 200 is separated from the main body 10, the pressing part 230 of the paper feeding cassette 200 may be spaced apart from the operating arm 426. Therefore, the pressing force exerted to the operating arm 426 is released. Accordingly, the supporting arm 424 may pivot downward by its own weight so as to separate the multi-sheet feeding prevention member 410 from the pickup roller 300. In such state, a sheet of paper that has become jammed between the pickup roller 300 and the multi-sheet feeding prevention member 410 during a pickup operation, the user is able to remove the paper with ease. Moreover, damages to the components, such as, for example, the pickup roller 300, the pickup shaft 310, and/or the multi-sheet feeding prevention member 410, that may have otherwise occurred in a conventional paper feeding device when the user forcibly pulls on the jammed paper, may be prevented.

An elastic member 430 may further be disposed between the pressing part 230 of the paper feeding cassette 200 and the operating arm 426 of the holder 420 in order to bias the holder 420 so that the multi-sheet feeding prevention member 410 elastically pushes the pickup roller 300. The elastic member 430 may comprise, for example, a compressed coil spring.

One end of the elastic member 430 may be supported by the operating arm 426 while the other end may be supported by the pressing part 230 of the paper feeding cassette 200 mounted to the main body 10. The operating arm 426 of the holder 420 may further be provided with a connection protrusion 426*a* for mounting the elastic member 430.

Furthermore, the operating arm 426 may further comprise a cap 440 to prevent the separation of the elastic member 430. The cap 440 may be constituted by a cap body 441 receiving the elastic member 430 and a hook part 442 formed at an end of the cap body 441 for coupling the cap body 441 with the operating arm 426. The operating arm 426 may additionally include a penetration hole 426*b* for receiving the hook part 442. The hook part 442 may extend from the cap body 441 by a sufficient length so as to allow the cap 440 to move forward and backward while coupled to the operating arm 426.

Hereinafter, the paper feeding operation and the jam removal operation of the image forming apparatus will be described with reference to FIGS. 2 and 3.

In a state where the paper feeding cassette 200 is mounted to the main body 10 as shown in FIG. 2, the paper feeding cassette 200 elastically supports the elastic member 430 mounted to the operating arm 426 of the holder 420, thereby pressing the operating arm 426. Therefore, the multi-sheet feeding prevention member 410 mounted to the supporting arm 424 is brought into close contact with the pickup roller 300 by a rotational force applied in the direction A.

In such state, when the pickup roller 300 rotates, the uppermost sheet of the paper S stacked in the knock-up plate 220 is picked up by the pickup roller 300. Since the multi-sheet feeding prevention member 410 presses against the pickup roller 300, multi-sheet feeding of the paper may be prevented.

When a paper jam occurs during the paper pickup operation, the paper may be caught between the pickup roller 300 and the multi-sheet feeding prevention member 410 as shown in FIG. 3.

If the paper feeding cassette 200 is separated from the main body 10 in this state, the pressing force of the paper feeding cassette 200 exerted to the operating arm 426 is released, and therefore the holder 420 pivots in the direction B by its own weight. Accordingly, since the pressing force between the pickup roller 300 and the multi-sheet feeding prevention member 410 is released, the user is able to easily remove the jammed paper.

While the disclosure has been particularly shown and described with reference to several embodiments thereof with particular details, it will be apparent to one of ordinary skill in the art that various changes may be made to these embodiments without departing from the principles and spirit of the invention, the scope of which is defined in the following claims and their equivalents.

What is claimed is:

1. An image forming apparatus, comprising:

a main body configured to support a printing device therein;

a printing media feeding cassette detachably mounted to the main body, the printing media feeding cassette being configured to support one or more printing media therein;

a pickup roller configured to pick up a printing medium from the printing media feeding cassette; and a multi-sheet feeding prevention unit configured to impart a pressing force on the pickup roller when the multi-sheet feeding prevention unit is in a contact position and to release the pressing force to the pickup roller when the multi-sheet feeding prevention unit is in a releasing position, the multi-sheet feeding prevention unit being in the contact position when the printing media feeding cassette is mounted to the main body and being in the releasing position when the printing media feeding cassette is at least partially detached from the main body, wherein the multi-sheet feeding prevention unit comprises:

a holder including a supporting arm extending from a rotation shaft and having a multi-sheet feeding prevention member facing the pickup roller and an operating arm to drive the supporting arm; and an elastic member positioned between the operating arm and the printing media feeding cassette.

2. The image forming apparatus according to claim 1, wherein the printing media feeding cassette, when mounted in the main body, presses against the elastic member so that the multi-sheet feeding prevention member is in a pressing contact with the pickup roller.

3. The image forming apparatus according to claim 1, wherein the elastic member elastically biases the holder in such a manner as to elastically bias the multi-sheet feeding prevention member toward the pickup roller when the printing media feeding cassette presses against the elastic member.

4. The image forming apparatus according to claim 3, wherein an end of the elastic member is supported by the holder while the other end of the elastic member receives pressure from the printing media feeding cassette when the printing media feeding cassette presses against the elastic member.

5. The image forming apparatus according to claim 1, wherein the operating arm extends from the rotating shaft and is configured to face the printing media feeding cassette.

6. The image forming apparatus according to claim 1, wherein the multi-sheet feeding prevention unit further comprises a cap coupled to the operating arm and configured to receive the elastic member.

7. The image forming apparatus according to claim 1, further comprising:

a guide frame having a guide surface by which the printing medium picked up by the pickup roller is guided along a paper feed path, wherein the holder is rotatably mounted to the guide frame.

8. An image forming apparatus, comprising:

a printing media feeding cassette having a paper receiving surface on which one or more sheets of paper are to be stacked;

a pickup roller configured to pick up a paper from the printing media feeding cassette; and a multi-sheet feeding prevention unit moveable between a contact position and a releasing position and having a multi-sheet feeding prevention member supported on an end thereof, the multi-sheet feeding prevention unit being configured to be in the contact position when the multi-sheet feeding prevention unit is in an interfering contact with the printing media feeding cassette, the multi-sheet feeding prevention member imparting a first pressing force on the pickup roller when the multi-sheet feeding prevention unit is in the contact position, the multi-sheet feeding prevention unit being configured to be in the releasing position when the multi-sheet feeding prevention unit is not in contact with the printing media feeding cassette, the multi-sheet feeding prevention member imparting no pressing force on the pickup roller when the multi-sheet feeding prevention unit is in the releasing position, the multi-sheet feeding prevention unit including a holder having at least one rotating arm coupled to a rotational shaft such that the multi-sheet feeding prevention member is in the contact position when the arm is rotated in a first rotation direction and the multi-sheet feeding prevention member is in the releasing position when the arm is rotated in a second rotation direction opposite the first direction, the at least one rotating arm including an operating arm extending from the rotational shaft in a direction away from the pickup roller and having a surface opposingly facing the printing media feeding cassette, the multi-sheet feeding prevention unit including an elastic member positioned between the operating arm and the printing media feeding cassette to elastically bias the multi-sheet feeding prevention unit toward the pickup roller when the multi-sheet feeding prevention unit is in the interfering contact with the printing media feeding cassette.

9. The image forming apparatus of claim 8, wherein the holder is rotatably disposed in the image forming apparatus and configured to support the multi-sheet feeding prevention member, and one end of the elastic member is supported by the holder while the other end receives pressure from the printing media feeding cassette when the printing media feeding cassette is in contact with the elastic member.

10. The image forming apparatus of claim 9, wherein the at least one rotating arm includes a supporting arm extending from the rotating shaft in a first direction toward the pickup roller, the supporting arm supporting the multi-sheet feeding prevention member at one end thereof away from the rotating shaft, and an operating arm extending from the rotating shaft in a second direction away from the pickup roller, the operating arm having a surface opposingly facing the printing media feeding cassette.

11. The image forming apparatus of claim 10, wherein the printing media feeding cassette is configured to press against the elastic member so as to bias the multi-sheet feeding prevention member toward the pickup roller when the printing media feeding cassette presses against the elastic member.

12. The image forming apparatus of claim 10, further comprising:

a guide frame having a guide surface by which the printing medium picked up by the pickup roller is guided along a paper feed path defined within the image forming apparatus, wherein the holder is rotatably supported on the guide frame.

13. A printing media feeding device of an image forming apparatus that includes a printing media feeding cassette in which to receive one or more printing media, comprising:

a pickup roller configured to pickup up a printing medium from the printing media feeding cassette; and a multi-sheet feeding prevention unit having a holder configured to rotate about a rotational shaft in cooperation with the printing media feeding cassette of the image forming apparatus, a multi-sheet feeding prevention member facing the pickup roller, and an elastic member positioned between the printing media feeding cassette and the holder; and an operating arm extending from the rotational shaft in a second direction away from the pickup roller, the operating arm having a surface opposingly facing the printing media feeding cassette, wherein the elastic member is positioned between the printing media feeding cassette and the operating arm such that the elastic member elastically biases the multi-sheet feeding prevention unit towards the pickup roller when the printing media feeding cassette presses against the elastic member.

14. The printing media feeding device of claim 13, wherein the multi-sheet feeding prevention unit is rotatable about the rotational shaft between a pressing position and a releasing position, the multi-sheet feeding prevention unit being in the pressing position when the multi-sheet feeding prevention unit is in an interfering contact with the printing media cassette installed in the image forming apparatus, the multi-sheet feeding prevention unit being in the releasing position when the multi-sheet feeding prevention unit is not in contact with the printing media cassette, the multi-sheet feeding prevention member imparting a first pressing force on the pickup roller when the multi-sheet feeding prevention unit is in the pressing position, the multi-sheet feeding prevention member imparting a second pressing force less than the first pressing force on the pickup roller when the multi-sheet feeding prevention unit is in the releasing position.

15. The printing media feeding device of claim 13, wherein the holder further comprises:

a supporting arm extending from the rotational shaft in a first direction toward the pickup roller, the supporting arm supporting the multi-sheet feeding prevention member at one end thereof away from the rotational shaft; and.

16. The printing media feeding device of claim 15, wherein, when the printing media feeding cassette is in pressing contact with the operating arm of the multi-sheet feeding prevention unit, the multi-sheet feeding prevention member imparts a first pressing force on the pickup roller, and wherein, when the operating arm of the multi-sheet feeding prevention unit is not in contact with the printing media cassette, the multi-sheet feeding prevention member imparts no pressing force on the pickup roller.

17. A printing media feeding device, comprising:

a pickup roller to pick up a printing medium from a printing medium cassette; and a multi-sheet-feeding prevention unit having a support arm extending from a rotation shaft in a first direction, the support arm having a multi-sheet-feeding prevention member facing the pickup roller, the multi-sheet-feeding prevention unit having an operation arm connected to the support arm and extending from the rotation shaft in a second direction different from the first direction, such that a side of the operation arm is positioned to face the printing medium cassette and when the printing medium cassette applies a force to the side of the operation arm, each of the operation arm and the support arm rotate about the rotation shaft, wherein the multi-sheet-feeding prevention unit further includes an elastic member positioned between the operation arm and the printing medium cassette to elastically bias the multi-sheet-feeding prevention unit toward the pickup roller when the printing medium cassette applies a force to the side of the operation arm.

18. An image forming apparatus, comprising:

a printing medium cassette to store a printing medium;

a pickup roller positioned to pick up the printing medium from the printing medium cassette; and a multi-sheet-feeding prevention unit having a support arm extending from a rotation shaft in a first direction, the support arm having a multi-sheet-feeding prevention member facing the pickup roller, the multi-sheet-feeding prevention unit having an operation arm connected to the support arm and extending from the rotation shaft in a second direction different from the first direction, such that a side of the operation arm is positioned to face the printing medium cassette and when the printing medium cassette applies a force to the side of the operation arm, each of the operation arm and the support arm rotate about the rotation shaft, wherein the multi-sheet-feeding prevention unit further includes an elastic member positioned between the operation arm and the printing medium cassette to elastically bias the multi-sheet-feeding prevention unit toward the pickup roller when the printing medium cassette applies a force to the side of the operation arm.

19. The image forming apparatus of claim 18, wherein the printing medium cassette is removable from the image forming apparatus, such that when the printing medium cassette is in a printing position in which the pickup roller picks up the printing medium from the printing medium cassette, the printing medium cassette applies the force to the side of the operation arm, and when the printing medium cassette is removed from the printing position, the force applied to the operation arm by the printing medium cassette is decreased.

* * * * *